United States Patent [19]

Kildea

[11] 4,311,432

[45] Jan. 19, 1982

[54] RADIAL SEAL

[75] Inventor: Robert J. Kildea, Juno Isles, Fla.

[73] Assignee: United Technologies Corporation, Hartford, Conn.

[21] Appl. No.: 96,101

[22] Filed: Nov. 20, 1979

[51] Int. Cl.[3] ..... F01D 25/24

[52] U.S. Cl. ..... 415/134; 415/139

[58] Field of Search ..... 415/134, 135, 136, 137, 415/138, 139, 9, 115, 116; 60/39.32

[56] References Cited

U.S. PATENT DOCUMENTS

| | | | |
|---|---|---|---|
| 2,991,045 | 7/1961 | Tassoni | 415/135 |
| 4,063,845 | 12/1977 | Allen | 415/134 |
| 4,184,689 | 1/1980 | Brodell et al. | 415/134 |

*Primary Examiner*—Robert E. Garrett

*Attorney, Agent, or Firm*—Norman Friedland

[57] ABSTRACT

A thin ring fabricated from a relatively low thermal expansion material located between the engine case and the outer air seal segments and adjacent vane segments serves to seal the gap between the adjacent vane segments and outer air seal segments by virtue of deforming the ring caused by the expansion of the case.

2 Claims, 3 Drawing Figures

RADIAL SEAL

BACKGROUND OF THE INVENTION

This invention relates to turbine type of power plants and particularly to seal means for the gap existing between the outer air seal of the rotor blades and adjacent vanes for sealing the cooling air in the cooling cavities outboard the gas path therefrom.

Owing to the advent of high performance engine, particularly in light of the concern for fuel conservation there has been an increasing awareness of avoiding air leakages in the engine. Obviously any leakage is in reality a loss of energy and hence adverse to fuel economy.

This invention is directed to the sealing of the gap that exists between the rotor blade, outer air seal and the adjacent vane at the junction point where the outer air seal and vanes are tied to the engine case. I have found that by utilizing a relatively thin ring fabricated from a low thermal expansion material (lower than the case) the forces created by the heated case during expansion forces the ring to bear against the vane structure and outer air seal structure deforming to provide a good seal. This serves to seal the cooling cavities located outboard of the gas path to prevent the higher pressure cooling air from ingressing into the gas path. It is contemplated that the seal be assembled into the engine with a loose fit ring. When the engine is operated, the generated heat causes the case to expand, which is at a rate that is faster than the low expansion seal. This causes the segments of the outer air seal and vane to move in a direction to bear against the seal. At operating temperature the seal is stretched elastically causing it to deform and conform to the contour of the walls of these segments. This gives a good metal to metal contact causing a satisfactory seal.

SUMMARY OF THE INVENTION

A feature of this invention is to provide a seal between the vane and outer air seal segments in a turbine type power plant so as to seal the cooling air cavities from the gas path to prevent the higher pressure cooling air from ingressing into the gas path.

A feature of this invention is to provide relatively thin hoop fabricated from a material having a lower thermal expansion value than the engine case so that the expansion of the case causes the seal to bear against the segments and form a good metal to metal (surface-to-surface) contact.

Other features and advantages will be apparent from the specification and claims and from the accompanying drawings which illustrate an embodiment of the invention.

DESCRIPTION OF THE PREFERRED EMBODIMENT

Figure 1:
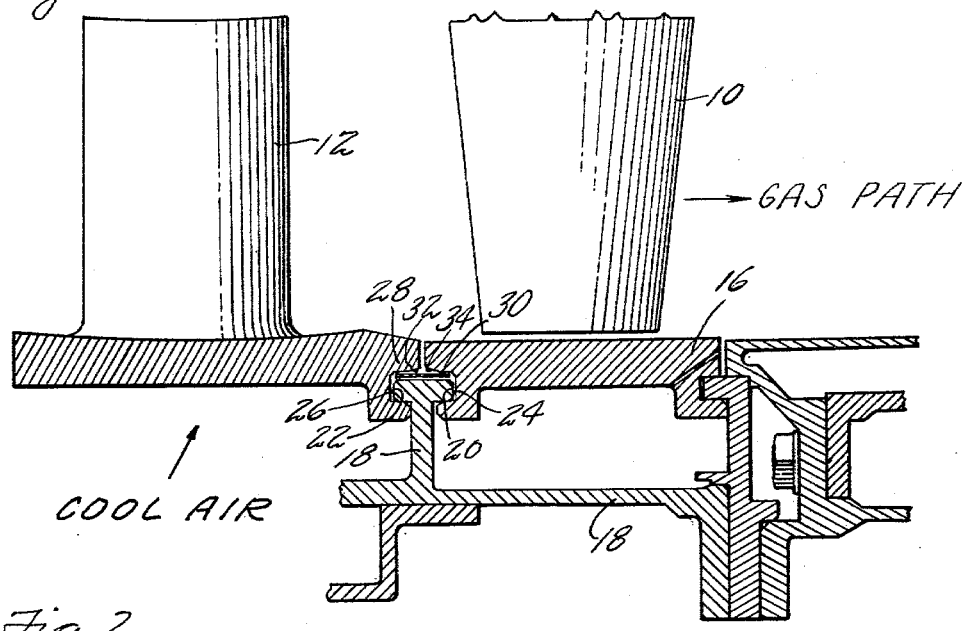
FIG. 1 is a partial view partly in section and partly in elevation showing the details of this invention.
Figure 2:
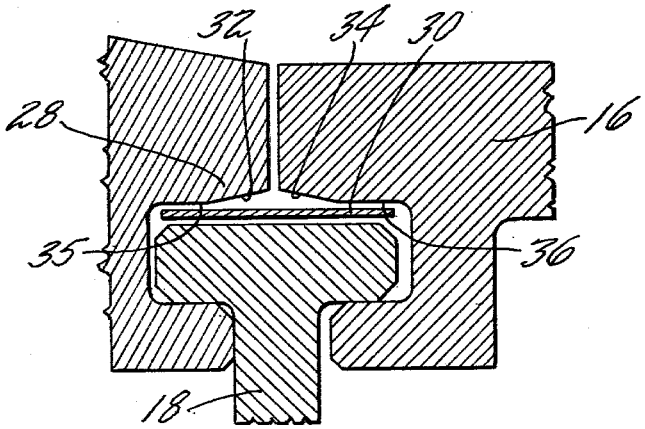
FIG. 2 is a blown-up partial view showing the seal in a non-deformed condition.
Figure 3:
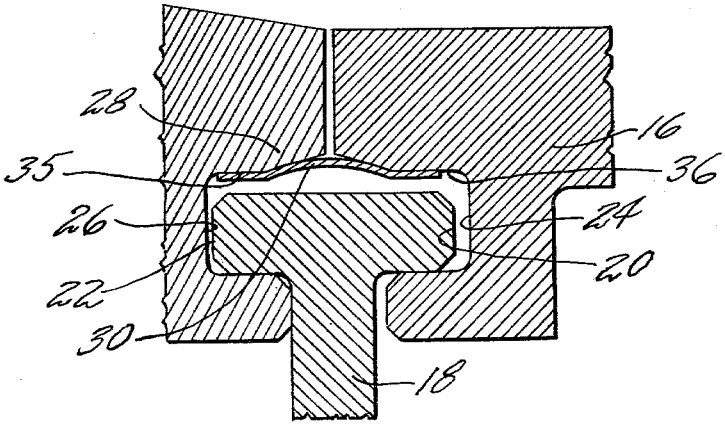
FIG. 3 is a blown-up partial view showing the seal in its deformed configuration.

FIGS. 1, 2 and 3 are a partial showing of the turbine section of a gas turbine engine having the turbine blade 10 mounted adjacent the vane 12. For convenience and simplicity only those elements necessary for an understanding of this invention are shown and further details of engine may be had by referring to any one of the engine models, as the JT-3, JT-8, JT-9 and the like engines manufactured by Pratt and Whitney Aircraft Group, division of United Technologies Corporation.

As shown in FIG. 1, a segment of the outer air seal 16 is secured into position adjacent the tip of the rotor by the hook connections formed on the inner diameter of the engine case 18. The hook portion 18 is formed in annular opposing lips 20 and 22 that fit into annular grooves 24 and 26 formed in one side of the outer air seal 16 and vane platform 28.

It is apparent from the foregoing that the segments of the vanes and outer air seal are tied to the engine case and expansion of the case will cause the vanes and outer air seal to move radially outward.

According to this invention ring or hoop seal 30 is disposed between the end of the hook portion 18 and the outer diameter faces of the vane platform 28 and outer air seal 16. At room temperature ring 30 fits loosely in this space as shown in FIG. 2 and at elevated temperatures owing to the differential in thermal expansion between the ring and case, the ring deforms and bears against the cylindrical surfaces 35 and 36 and deforms into the beveled surfaces 32 and 34 of the vane platform 28 and outer air seal 16, respectively. A suitable material for the ring is Thermex which is an iron alloy consisting of 38% nickel, 1.4% titanium and columbium, 3% tungsten, 15% cobalt, 0.9% aluminum and 0.05% boron, by weight or material identified as Inco 903.

In this configuration the diameter of the case is approximately 30 inches and this type of seal is particularly efficacious in the higher diameter engines, such as the one described herein.

It should be understood that the invention is not limited to the particular embodiments shown and described herein, but that various changes and modifications may be made without departing from the spirit and scope of this novel concept as defined by the following claims.

I claim:

1. A turbine type power plant having a generally cylindrical outer casing surrounding at least one set of vanes and its adjacent rotor, a segmented generally cylindrically shaped outer air seal between the casing and the tips of the blades on said rotor, platform adjacent the outer edges of said set of vanes and being in substantially axial alignment with but spaced from said outer air seal defining a gap forming a leakage path of engine cooling air into the gas path, a tie connection extending radially inward from said casing securing said platform and said outer air seal and being disposed adjacent said gap, seal means for said gap disposed between the end of said tie connection and overlying a portion of said platform and said outer air seal and extending across said gap, said seal means being a continuous ring-like element and having a relative low thermal expansion in relation to said case whereby heating of said case deforms said seal means to position it into contact with said platform and outer air seal and seal said gap.

2. Apparatus as in claim 1 wherein the edge of said platform and the adjacent edge of said outer air seal adjacent said gap is beveled radially outward whereby said ring-like element tends to deform into said space formed by said bevels.

* * * * *